US006233858B1

(12) United States Patent
Brach, Jr. et al.

(10) Patent No.: US 6,233,858 B1
(45) Date of Patent: May 22, 2001

(54) APPARATUS FOR PROVIDING ADVERTISEMENT ON A GASOLINE PUMP HOSE

(76) Inventors: Philip L. Brach, Jr., 1834 N. Wood St., Garden Apartment; Robert Mead, 1735 N. Paulina St., Suite 307, both of Chicago, IL (US) 60622

( * ) Notice: Subject to any disclaimer, the term of this patent is extended or adjusted under 35 U.S.C. 154(b) by 0 days.

(21) Appl. No.: 09/139,413

(22) Filed: Aug. 25, 1998

Related U.S. Application Data

(60) Provisional application No. 60/056,245, filed on Aug. 28, 1997.

(51) Int. Cl.[7] ..... G09F 3/18

(52) U.S. Cl. ..... 40/660; 40/661.06; 40/658; 40/665; 40/607

(58) Field of Search ..... 40/316, 607, 643, 40/651, 660, 661.03, 661.06, 661.12, 665, 779, 658, 666

(56) References Cited

U.S. PATENT DOCUMENTS

| | | | | |
|---|---|---|---|---|
| 1,410,598 | * | 3/1922 | Reeves | 40/734 X |
| 1,490,882 | * | 4/1924 | Anderson | 40/658 |
| 1,499,169 | * | 6/1924 | Gill | 40/607 X |
| 1,848,950 | * | 3/1932 | Hammes | 40/660 |
| 1,949,180 | * | 2/1934 | Rettich | 40/761 X |
| 2,242,331 | * | 5/1941 | Sprung | 40/607 |
| 2,678,707 | | 5/1954 | Finkelstein . | |
| 2,930,155 | | 3/1960 | Becker . | |
| 3,605,200 | | 9/1971 | Vallinotto et al. . | |
| 4,079,530 | * | 3/1978 | Atherton et al. | 40/651 X |
| 4,292,749 | * | 10/1981 | Thomas | 40/308 |
| 4,465,209 | | 8/1984 | Wilder . | |
| 4,777,750 | * | 10/1988 | Garfinkle | 40/606 X |
| 4,805,331 | * | 2/1989 | Boggess et al. | 40/651 |
| 5,199,199 | * | 4/1993 | Garfinkle | 40/5 |
| 5,335,889 | * | 8/1994 | Hopkins et al. | 40/607 X |
| 5,412,547 | | 5/1995 | Hornblad et al. . | |
| 5,864,977 | * | 2/1999 | Alvern | 40/658 |

FOREIGN PATENT DOCUMENTS

| | | | | |
|---|---|---|---|---|
| 2224152 | * | 4/1990 | (GB) | 40/607 |
| 2228355 | * | 8/1990 | (GB) | 40/607 |

* cited by examiner

*Primary Examiner*—Brian K. Green
(74) *Attorney, Agent, or Firm*—Pillsbury, Winthrop LLP

(57) ABSTRACT

An apparatus for providing advertising on a gas pump hose includes a frame with a slide located on one edge that can be slid into a slide housing located on a hose connector collar. The hose connector collar is connected to the gas pump hose by a clamp located at opposite ends of the hose connector collar. Advertising structure is placed within the frame and at eye level of a customer of the service station to maximize the effect of the advertisement while the customer is at the service station.

12 Claims, 7 Drawing Sheets

APPARATUS FOR PROVIDING ADVERTISEMENT ON A GASOLINE PUMP HOSE

This Application claims the benefit of Provisional No. 60/056,245 filed Aug. 28, 1997.

BACKGROUND OF THE INVENTION

1. Field of Invention

This invention relates to methods and structures for displaying advertising. In particular, this invention concerns a clamp and advertising structure for attaching, e.g., multimedia information, coupons, or advertisements, to a gas pump hose, and a method of providing advertisement on a gas pump hose.

2. Description of Related Art

The use of advertising at gasoline service stations is well known in the art. Most service stations have standalone signs that can be lighted and seen up close or from a roadway. Advertising also appears on the face of the gasoline pump, on smaller signs that stand alone on the ground, and even on the squeegee handles that protrude from the water bins in the service station.

A problem with these types of advertisements is that they do not take advantage of the time at which a customer pumps gasoline into a vehicle, which is probably the largest span of time in which the customer is present at the service station. This is especially true since the advent of credit card accepting gasoline pumps, which can severely limit the potential to sell "impulse" items at the cashier's stand. Accordingly, there is a need to provide advertising that is readily visible to the customer while the customer is pumping gasoline into a vehicle.

An additional problem with known gas station advertisements is that they are, typically, permanent signs that are not removable from the structure to which they are attached. For example, the advertisements on the gas pump are usually imprinted on the face of the pump and cannot be easily interchanged with other advertisements. Standalone signs are sometimes painted and are very large, which prevents easy interchanging of advertising on the signs. Accordingly, there is an additional need to provide advertising at a gas station that is easily interchangeable.

U.S. Pat. No. 4,465,209 to Wilder discloses a typical advertising structure for a gasoline pump. The advertising is built into the handle of the gas pump and provides a small surface in which advertising indicia can be placed. This small advertising surface is not located at eye level and does not allow a significant amount of information to be communicated to the customer at the gasoline pump. In addition, this advertising surface requires a great deal of modification of the gas pump handle to accept placement of advertising.

U.S. Pat. No. 2,930,155 to Becker discloses a fuel delivery information device. The device is attached between the cap and the outer cap end of a fuel tank inlet to provide an information bearing surface which will be seen whenever the cap is removed. The objective of the Becker device is to provide fueling information to a person filling a fuel tank. The information bearing surface is not provided or adapted to be provided on a gasoline fuel hose.

The industry lacks a sturdy, inexpensive advertising structure that is designed to take advantage of the time in which a customer is pumping gasoline. No gas hose advertising structure is known that is easily interchangeable and at eye level throughout the gas pumping process.

SUMMARY OF THE INVENTION

One apparatus for providing advertising on a gasoline pump hose includes a frame that comprises two frame halves that are held or clamped together to secure an advertisement structure between the frame halves. The frame can slide onto a hose connector collar, which is attached to or clamped onto the hose.

A hinge, for example, a living hinge, can be provided to connect the two frame halves together, and a series of indents and outdents located on each of the frame halves can lock the frame halves together. Slide halves run along the length of a side portion of the frame that is opposite the hinge. The slide halves may include a molded portion on each of the frame halves and a slide cutaway to allow a slide housing on the hose connector collar to slide with respect to and lock onto the combined slide halves. Slide locking indents can be provided on the slide and mate with slide locking outdents in the slide housing to allow the frame to be locked onto the hose connector collar regardless of the longitudinal orientation of the hose connector collar.

The hose connector collar may include a slide housing for receiving and locking the combined slide halves of the frame onto the hose connector collar. The slide housing includes a slide chamber in which the slide halves are inserted and has slide housing cutaways to reduce the amount of material used and to facilitate manufacture of the hose connector collar. In addition, the slide housing cutaways facilitate the manufacture of the slide locking outdents onto the wall of the slide chamber. A semi-cylindrical portion attached to the slide housing mates with the gas pump hose and stabilizes the advertising device on the hose.

The hose connector collar can be attached to the hose by any known clamping means or attachment means. In a preferred embodiment, flanges are provided on the edges of the hose connector collar and work in cooperation to provide a clamp runway at each end of the hose connector collar.

In embodiments, the hose connector collar can be connected to the hose by inserting a clamp or attachment device through clamp insertion throughways located at either end of the slide housing.

In accordance with a first aspect of the invention, an apparatus for providing advertisement on a gasoline pump hose is disclosed in which an advertising display structure is connectable to a gas pump hose by a connecting structure.

In accordance with a second aspect of the invention, an apparatus for interchangeably providing advertisement on a gasoline pump hose is disclosed in which a frame encloses an advertising media and is slidably connected to a hose connector collar. The hose connector collar includes a clamp structure for connection to a gas pump hose.

In accordance with a third aspect of the invention, a method for providing advertisement on a gasoline pump hose is disclosed which includes connecting an advertising structure onto a gasoline pump hose.

In accordance with a fourth aspect of the invention, a method for providing advertisement on a gasoline pump hose is disclosed which includes enclosing an advertising media within a frame structure, sliding the frame structure onto a hose connector collar, and clamping the hose connector collar onto a gas pump hose.

BRIEF DESCRIPTION OF THE DRAWINGS

Other characteristics and advantages of the present invention will emerge from reading the detailed description hereinbelow of nonlimiting embodiments of the invention, and examining the attached drawings wherein.

DETAILED DESCRIPTION OF PREFERRED EMBODIMENTS

Preferred embodiments of the invention will be described with reference to the drawings.

The apparatus for providing advertisement on a gasoline pump hose has a frame that cooperates with a hose connector collar. The hose connector collar can be clamped onto a gas pump hose. The frame, for example, is a single molded piece and has, for example, two frame halves connected together. The frame halves can be connected together using a hinge, for example, a living hinge. The frame halves can be folded inwardly and locked together to enclose an advertisement structure within the frame. When the frame is in a closed position, slide halves of each frame halves mate at the edge of the frame opposite the hinge. The slide halves form a cross section that easily slips into a complimentary shaped slide chamber formed on the hose connector collar. The slide halves can lock into the hose connector collar using cooperating slide locking outdents and slide locking indents of the slide chamber and the slide halves. The hose connector collar and frame can be connected to an existing gas pump hose by two clamps located at opposite ends of the hose connector collar.

In one preferred embodiment of the invention, a clamp rides along a clamp runway defined by flanges located on the edges of the hose connector collar. The flanges retain the clamp in position at each end of the hose connector collar and provide a finished look for the hose connector collar.

In another embodiment of the invention, a clamp insertion throughway is formed in the slide housing to retain a clamp in position at one or both ends of the hose connector collar.

Figure 1:
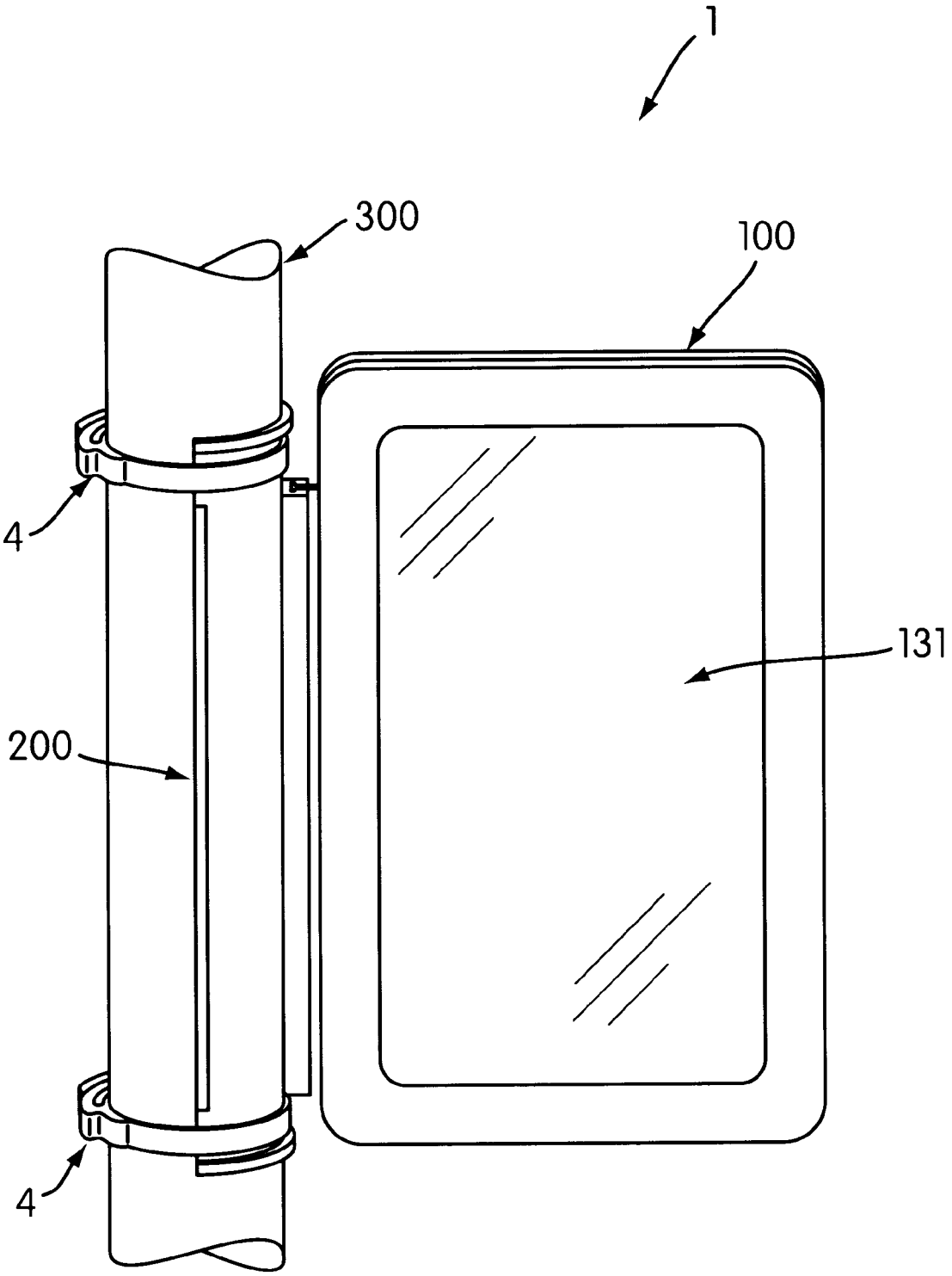
FIG. 1 is a perspective view of the apparatus for providing advertisement on a gasoline pump hose in accordance with a preferred embodiment of the invention.

FIG. 1 is a perspective view of a hose advertising device 1 in accordance with a preferred embodiment of the invention. A frame 100 made, for example, of plastic, is fixed or locked into position on a hose connector collar 200 and connected to a gasoline pump hose 300 by clamps 4.

An advertisement structure 131 is enclosed within the frame 100 to provide an advertising media at eye level. The advertising can be easily viewed from each side by customers as they dispense gasoline into their vehicles at a service station. The advertisement structure 131 can be any type of advertising media, including, but not limited to, the following: paper or cardboard with advertising indicia thereon, see-through plastic with advertising indicia thereon, a liquid crystal display panel, a computer screen display, a lighted advertisement display, brochures with multiple pages of advertisements, a magnetic board with magnetic indicia, a roll of advertisements that can move to change the advertisement displayed, a plurality of shutters that can move to change the advertisement displayed, and an advertisement structure that can be caused to move. Moreover, the advertising structure can encompass any type of multimedia information, in addition to, for example, a plurality of coupons, in roll or stacked form.

Figure 2:
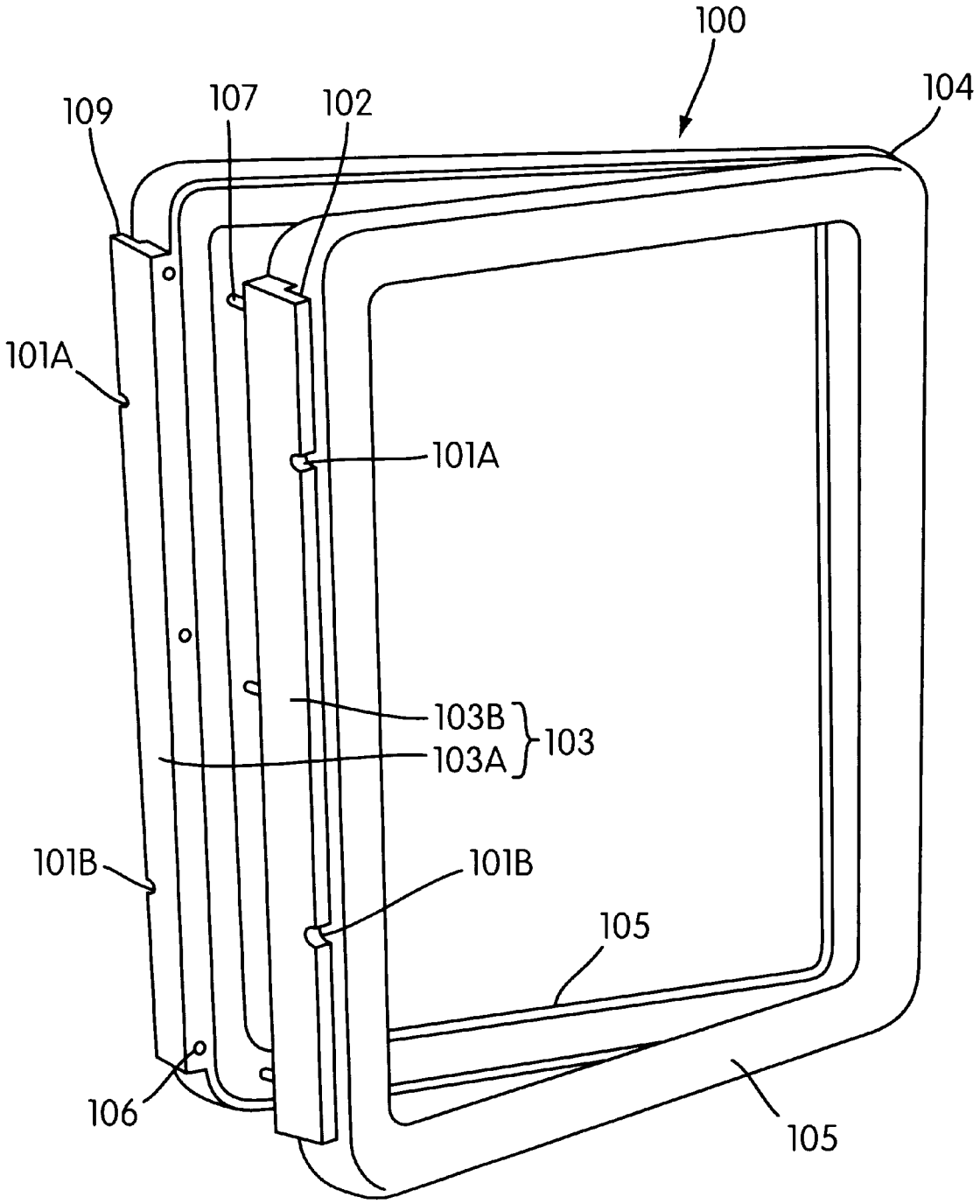
FIG. 2 is a perspective view of the frame in accordance with preferred embodiments of the invention.

FIG. 2 is a perspective view of the frame 100 in accordance with a preferred embodiment of the invention. The frame has two frame halves 105 connected together by a hinge 104, which may be a living hinge. The frame 100 can be a one-piece molded structure, and the living hinge 104 is a relatively thin portion that joins each of the frame halves 105 along one edge. The frame halves 105 may be joined by various other structures other than a living hinge 104, including a separate hinge structure, or the frame halves 105 may be resiliently snapped together.

The frame halves 105 close together to form a frame 100 that can sandwich the advertisement structure 131. When the frame 100 is in a closed position, the frame halves 105 can be locked together by frame halve lock indents 106 that meet with frame halve lock outdents 107, located on respective frame halves 105.

However, it is not necessary to include the frame halve lock indents 106 and frame halve lock outdents 107 because when the slide halves 103 are retained in the slide housing 201, the slide housing 201 prevents the slide halves 103 from separating. In fact, without the frame outdents and indents, the living hinge may advantageously cause the slide halves to separate and frictionally engage the inner sides of a slide housing 201 of the hose connector collar 200 (FIG. 3) to better secure the frame 100 to the slide housing 201.

Slide halves 103A and 103B are formed at an edge of each frame half 105. The slide halves mate when the frame 100 is in a closed position and protrude from an edge of the frame 100. Overhanging portions 109 define slide cutaway portions 102 on each slide half to create a T-shaped cross-section for the slide 103. The slide cutaway portions 102 also provide a runway for slide housing projections 212 to slide into and retain the slide 103 within the slide housing 201. Slide locking indents 101A and 101B are located at each end of the slide 103 and mate with a slide locking outdent 204 located at least at one end of the slide housing 201 to assure a solid connection between the frame 100 and the hose connector collar 200. One of the sets of indents 101A or 101B will engage with the outdent 204 depending on how the frame is connected to the connector collar 200.

The frame 100 can be constructed such that it is symmetrical about the living hinge. Thus, manufacture of the hinge is facilitated and advertising can be seen from either side of the frame 100.

Figure 3:
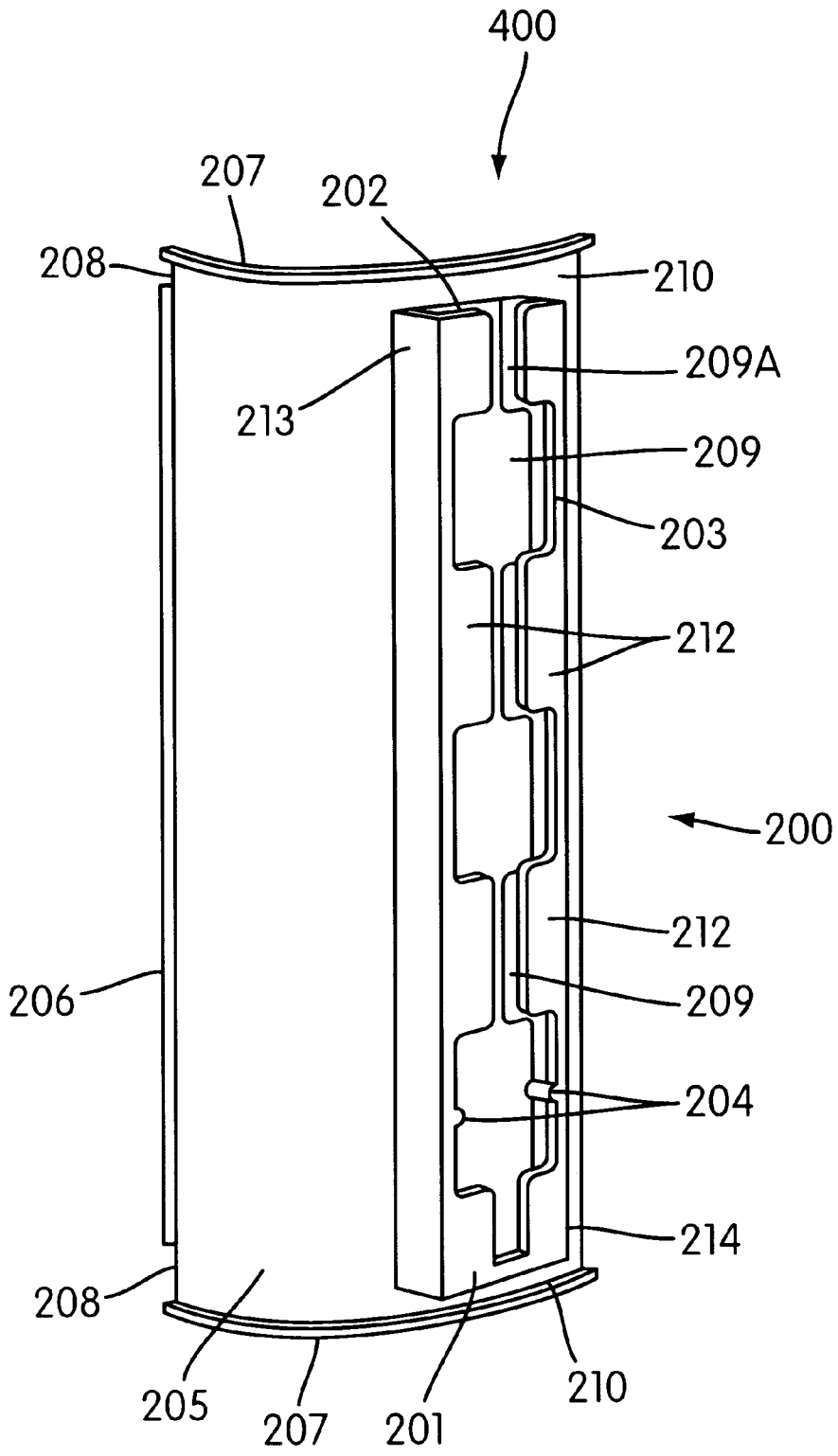
FIG. 3 is a perspective view of the hose connector collar in accordance with preferred embodiments of the invention.

FIG. 3 is a perspective view of the hose connector collar 200 in accordance with a preferred embodiment of the invention. Slide housing 201 is located in a longitudinal direction along a semi-cylindrical sleeve portion 205. The slide housing 201 includes a slide chamber or channel 202 into which the mating slide halves 103A and 103B (forming a slide 103) located on the frame 100 can be inserted. The slide halves 103A, 103B are inserted into an open end 213 of the slide housing 201 along a path as shown by direction arrow 400. The slide halves 103A, 103B are inserted until reaching the closed end 214 of the slide housing 201.

The slide housing 201 includes a plurality of slide housing cutaways 203 on a top surface of the slide housing 201. The slide cutaways 203 reduce the amount of material needed to manufacture the hose connector collar and facilitate the method of manufacturing and connecting the hose connector collar. The slide cutaways 203 reduce the surface contact area between the slide 103 and the slide housing 201, thereby reducing frictional resistance. An interior slide surface 209 may have an hourglass shape created by eliminating portions of the slide surface 209 formed below slide housing projections 212, thus creating slide surface through holes 209A.

The slide housing chamber 202 includes at least one slide locking outdent 204 located at an end of the slide housing 201 located opposite the open end 213 into which the slide 103 is inserted. Because there are slide locking indents 101A and 101B located at both ends of the slide halves 103A, 103B, regardless of which direction the slide 103 is inserted into the slide housing 201, one set of slide locking indents 101A or 101B will mate with the slide locking outdents 204 in the slide housing 201. Thus, even if the sleeve portion is connected to the hose 300 such that the open end of the slide channel 202 faces downward, the frame 100 will be reliably fixed in place. Preferably, however, the sleeve portion 205 is mounted on the hose 300 such that the closed end 214 of the slide channel 201 faces downward so that vibration and/or gravity will not cause the frame 100 to accidentally disengage from the connector collar 200.

The semi-cylindrical sleeve portion 205 of the hose connector collar 200 includes a longitudinal ridge 206 extending along the longitudinal edge of the semi-cylindrical portion 205. The longitudinal ridge 206 abuts a clamp runway 210 to provide a retaining structure for maintaining a clamp 4 in place at one or preferably both ends of the hose connector collar 200. A clamp retaining flange 207 is located along the top and bottom edges of the semi-cylindrical portion 205. The longitudinal ridges 206 (as well as the slide housing 201) also retain the clamp 4 in a predetermined axial position of the clamp runway 210 located at either end of the semi-cylindrical portion 205.

Figure 4:
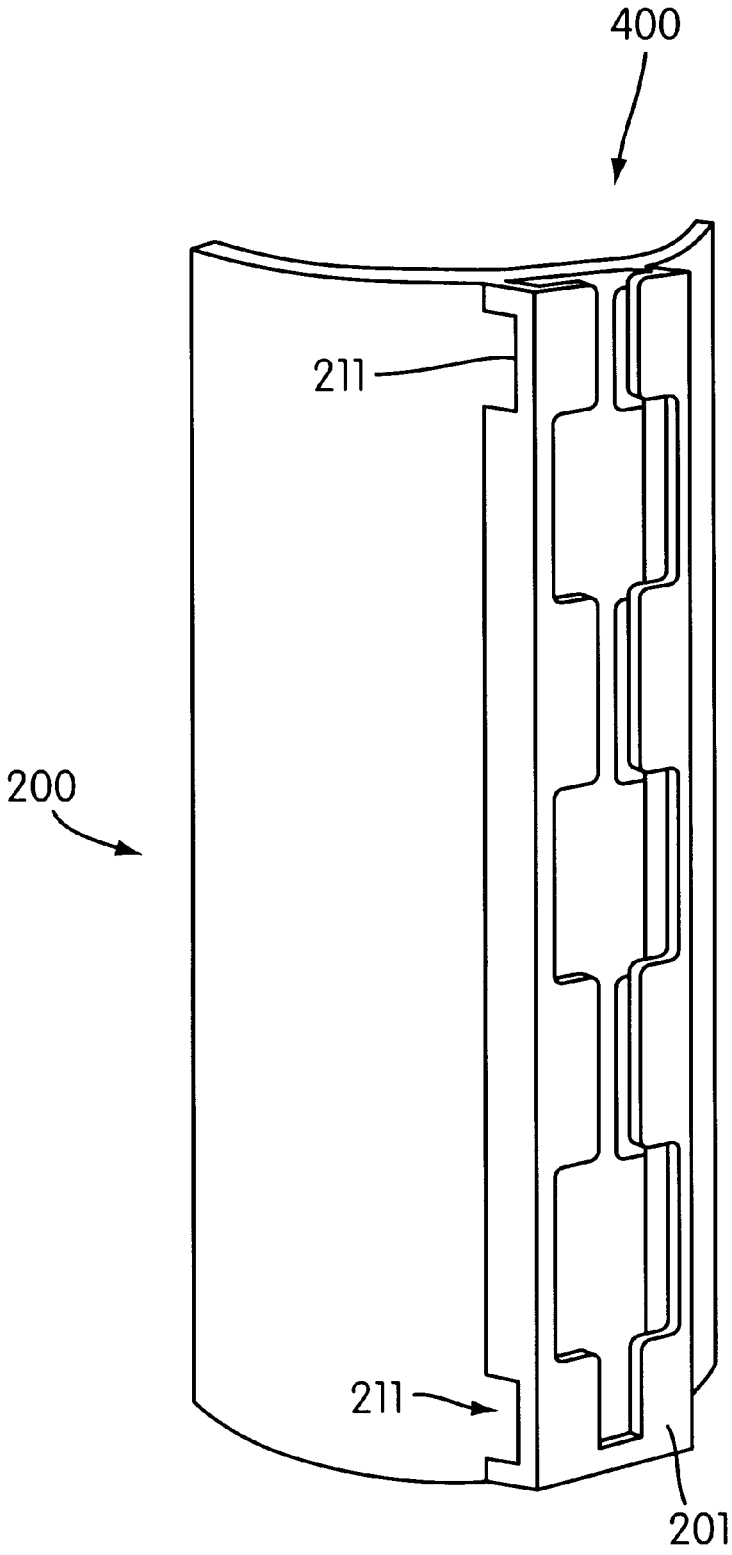
FIG. 4 is a perspective view of the hose connector collar in accordance with embodiments of the invention.

In embodiments as shown in FIG. 4, a clamp insertion throughway 211 can be located at either end of the slide housing 201 to retain a clamp structure that runs through the clamp insertion throughway 211 and around the hose connector collar 200. With this structure, the ridges 206 and flanges 207 of the FIG. 3 embodiment can be eliminated. The clamp structure secures the hose connector collar 200 to a gas pump hose. In addition, the clamp structure can serve as stops to prevent movement of the frame 100 once inserted into the slide channel 202. Of course, it is advantageous to structure the clamps such that there is no interference with the slide so as to facilitate removal of the slide from the slide channel.

Figure 5:
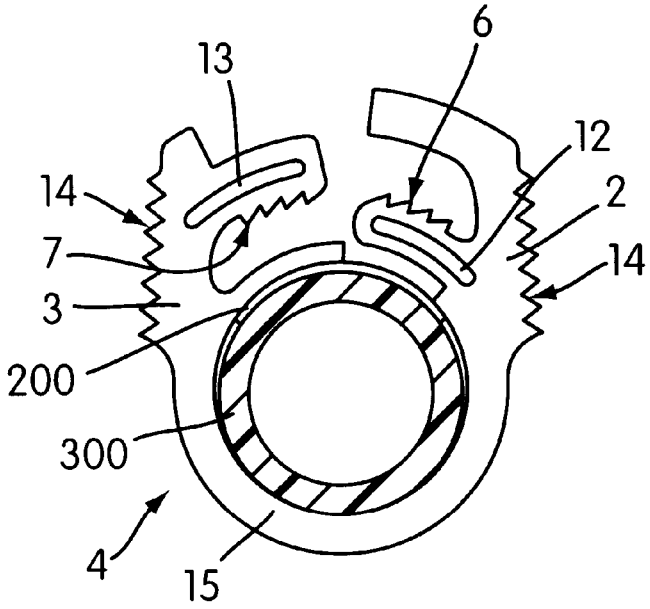
FIG. 5 is an elevational view of the clamp in an open state in accordance with embodiments of the invention.
Figure 6:
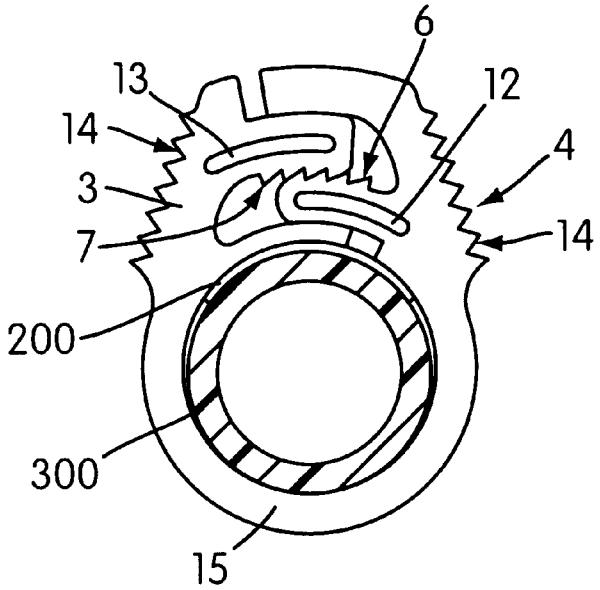
FIG. 6 is an elevational view of the clamp in a closed position in accordance with embodiments of the invention.

FIGS. 5 and 6 are elevational views of the clamp 4 in an open position and a closed position, respectively, in accordance with a preferred embodiment of the invention. An adjustable clamp for use with a variety of different hose sizes and diameters is disclosed in U.S. Pat. No. 3,605,200, incorporated herein by reference. Ring portion 15 has a pair of branches 2 and 3 located at ends of the ring portion 15. The branches 2 and 3 include a plurality of saw-like teeth 6 and 7 that mate with each other to lock the ring into a circular position when the branches 2 and 3 are drawn near to each other. Cuts 14 on the exterior of each branch 2 and 3 facilitate grasping and closing of the clamp 4, which causes the saw-like teeth 6 and 7 to mate with each other and lock the clamp 4 in a circular configuration. Slots 12 and 13 may be provided in each of the branches 2 and 3 to provide greater resiliency and ease in connection between the two branches 2 and 3. The clamp 4 provides quick and easy clamping of the hose connector collar 200 to a gas pump hose 300. The clamp 4 is easily removed from the gas pump hose and can be a one-piece molded structure that is economical to manufacture and can withstand the elements present at a gasoline service station. Other types of clamps may be used to connect the hose connector collar 200 to a gas pump hose 300, including: wire clamps, screw clamps, twist ties and string.

If clamp 4 as shown in FIGS. 5 and 6 is used, the hose connector collar 200 as shown in FIG. 4 must have the slide housing 201 assembled onto the semi-cylindrical portion 205 after clamps 4 are in place. Otherwise, clamp 4 will be unable to be inserted through the clamp insertion throughways 211. If the hose connector collar shown in FIG. 4 is of a one-piece molded construction, then other, more narrow, clamps, e.g., twist ties, etc., should be used for insertion into the clamp insertion throughways 211.

Figure 7:
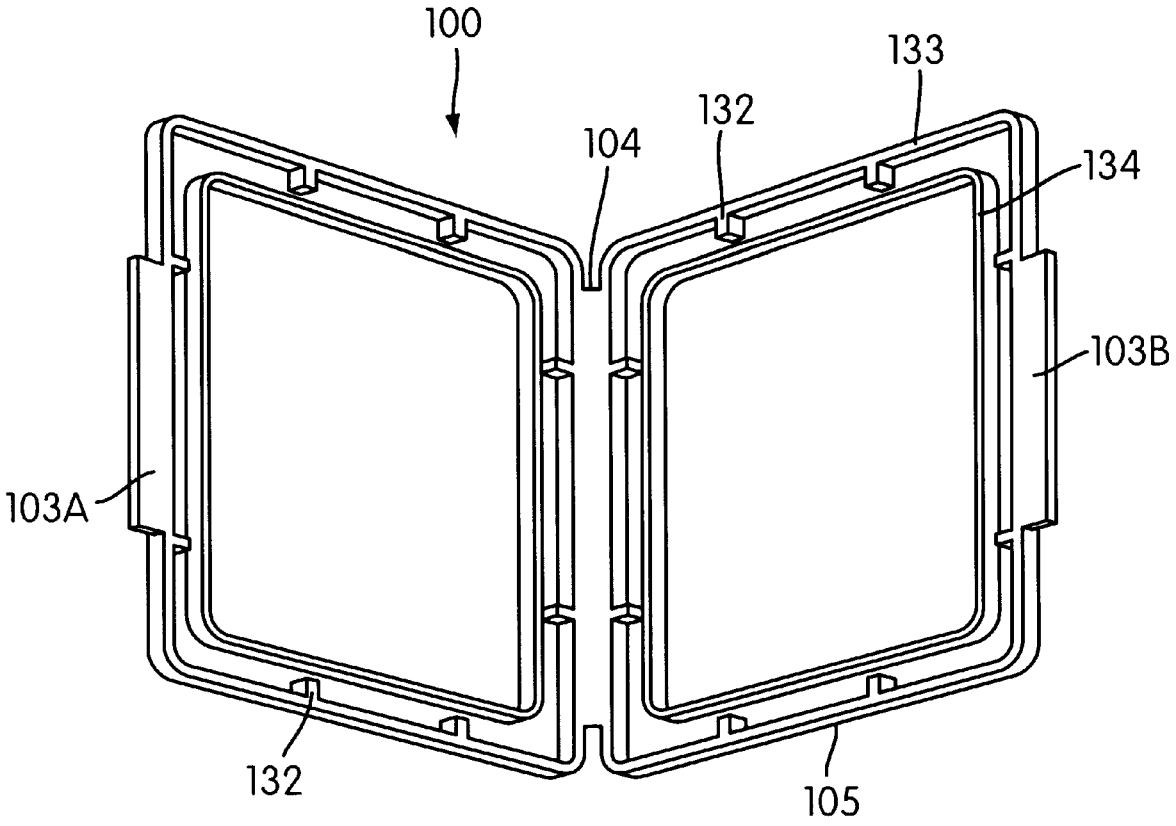
FIG. 7 is a second perspective view of the frame in accordance with embodiments of the invention.

FIG. 7 shows a second perspective view of the frame 100. The frame halves 105 as shown are symmetrically oriented about a living hinge 104. Each frame half 105 includes an outer border 133 and an inner border 134 along with slide halves 103A and 103B. The inside surface of the frame halves is provided with advertising structure spacers 132 which project from the outer border 133. The spacers are adjacent to offset, or match up, with respect to one another when the frame halves 105 are closed. The outer border 133 is slightly elevated with respect to the inner border 134 at the inside surface. Accordingly, an advertising structure 131 can be placed onto a planar surface that the inner border 134 defines and will be retained in place by the advertising structure spacers 132.

Figure 8:
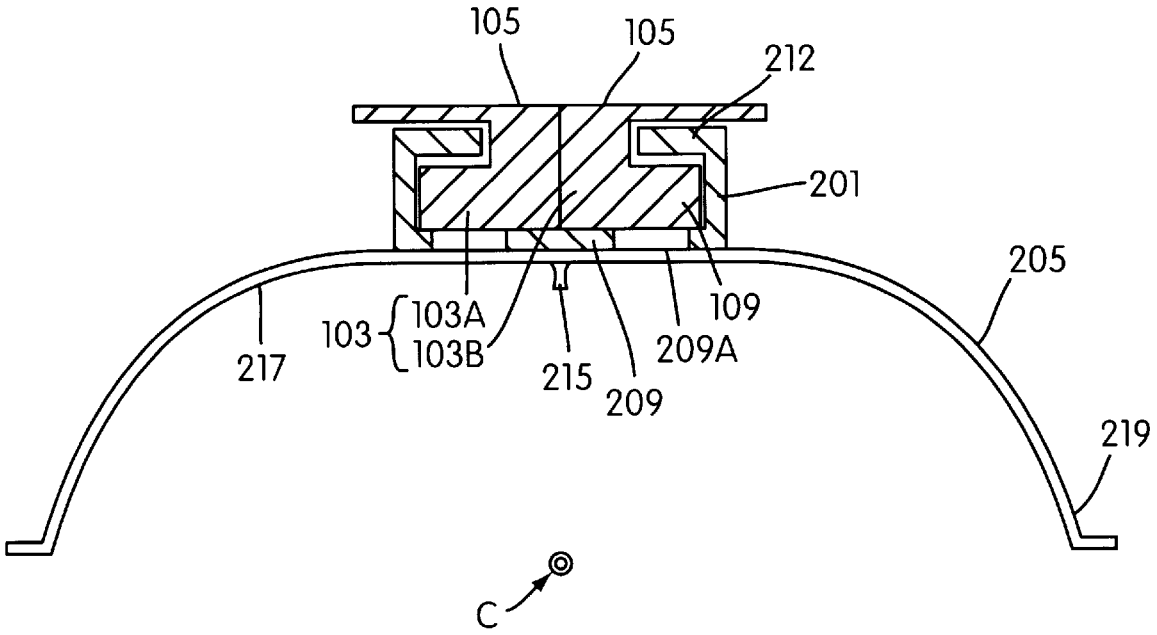
FIG. 8 is a cross-sectional view of the slide and slide housing in accordance with embodiments of the invention.

FIG. 8 is a cross-sectional view of the slide halves 103A and 103B as they are slidingly fit into the slide housing 201. Overhanging portions 109 interlock with the slide housing projections 212 to lock the slide halves 103A, 103B into the slide housing 201, thus retaining the frame 100 on the hose connector collar 200. FIG. 8 also shows dimples 215 (only one shown) that are intended to enhance gripping engagement between an inside surface 217 of the semi-cylindrical sleeve portion 205 and the hose 300. The dimples 215 are preferable formed on the inside surface 217 opposite to where the clamps 4 apply pressure to the outer surface 219 of the sleeve portion 205, to prevent relative movement between the sleeve portion 205 and the hose 300. Instead of, or in addition to, the dimples 215, an adhesive and/or a roughened surface could be used to enhance connection. FIG. 8 also shows that the semi-cylindrical portion 205 defines center of curvature C.

In operation, a user will place an advertising structure 131 onto the surface defined by the inner border 134 of frame halve 105. The frame halves 105 are closed together along the living hinge 104 to sandwich the advertising structure 131 between the frame halves 105. Because the frame halves 105 are symmetrical, a customer can view the advertising structure from either side of the frame 100. When the frame is in a closed position, the slide halves 103A and 103B form a slide 103 (FIG. 8) which can be slid into the slide housing 201 as shown by direction arrow 400 (FIGS. 3 and 4). The slide 103 is retained in the slide housing 201 by slide locking indents 101A and 101B which mate with slide locking outdents 204 in the slide housing 201. In addition, the slide 103 can be retained in the slide housing 201 by frictional force resulting from a tendency of the slide halves 103A and 103B to separate due to a separation force exerted by the living hinge 104. The slide housing 201 located on the hose connector collar 200 can be attached to an existing gas pump hose 300 at eye level by clamping the hose connector collar to the gas pump hose using clamps 4.

Replacing the advertising structure 131 can be easily accomplished by sliding the slide 103 (and frame 100) off of the hose connector collar 200, opening the frame halves 105 and replacing the advertising structure 131. The slide 103 can be slid back onto the hose connector collar 200 without ever removing the hose connector collar 200 and clamps 4 from the gas pump hose 300.

This invention has been described in conjunction with preferred embodiments of the invention. However, it is evident that many alternatives, modifications and variations will be apparent to those skilled in the art. Accordingly, preferred embodiments of the invention set forth herein are intended to be illustrative, not limiting. Various changes may be made without departing from the spirit and scope of the invention.

What is claimed is:

1. An apparatus for attaching advertising media on a gas pump hose, comprising:

a frame having two frame halves defining an advertising media space therebetween;

a hose connector collar connected to the frame, the hose connector collar having a slide housing; and a hinge about which the frame halves pivot between open and closed positions, wherein the frame halves include slide halves positioned opposite the hinge, and the slide halves are combined when the frame halves are pivoted to the closed position so that a portion of the slide halves fits within and is detachably connected to the slide housing of the hose connector collar with the frame halves locked in the closed position.

2. The apparatus according to claim 1, further comprising a series of mating indents and outdents located on each of the frame halves that lock the frame halves together.

3. The apparatus according to claim 1, further comprising slide locking indents provided on each said slide half that mate with slide locking outdents in the slide housing to allow the frame to be locked onto the hose connector collar.

4. The apparatus according to claim 1, wherein the slide housing includes a slide chamber in which the slide halves are inserted.

5. The apparatus according to claim 1, wherein the hose connector collar comprises a semi-cylindrical portion attached to the slide housing.

6. The apparatus according to claim 1, further comprising flanges provided on edges of the hose connector collar, each of the flanges defining with the edges of the hose connector collar a clamp runway for receiving a clamp.

7. The apparatus according to claim 1, wherein each end of the hose connector collar includes a clamp insertion throughway for receiving a clamp.

8. The apparatus according to claim 1, wherein the advertisement structure further comprises an advertising media positioned within the advertising media receiving space, said advertising media including a plurality of coupons.

9. The apparatus according to claim 8, wherein the plurality of coupons are movable to change the advertising media displayed.

10. An apparatus for interchangeably providing advertising media on a gas pump hose, comprising:

a hose connector collar having a substantially semi-cylindrical shape defining a center of curvature, the collar including a slide housing formed along a longitudinal axis passing through the center of curvature, the hose connector collar defining a clamp runway surface at each longitudinal end of the slide housing, each said clam runway surface extending along an arcuate path transverse to the longitudinal axis;

a frame defining a plane that intersects the longitudinal axis, said frame having an advertising media receiving space and being slidably connected to the slide housing of the hose connector collar; and a clamp provided for each said clamp runway surface of the hose connector collar.

11. The apparatus according to claim 10, further comprising an advertising media received within the advertising media receiving space, the advertising media including a plurality of coupons.

12. The apparatus according to claim 11, wherein the plurality of coupons are movable to change the advertising media displayed.

* * * * *